US007077108B2

(12) United States Patent
Fujita et al.

(10) Patent No.: US 7,077,108 B2
(45) Date of Patent: Jul. 18, 2006

(54) FUEL INJECTION APPARATUS

(75) Inventors: Mahoro M. Fujita, Fairport, NY (US); Hirohide Misu, Kanagawa (JP)

(73) Assignee: Delphi Technologies, Inc., Troy, MI (US)

( * ) Notice: Subject to any disclaimer, the term of this patent is extended or adjusted under 35 U.S.C. 154(b) by 4 days.

(21) Appl. No.: 10/950,996

(22) Filed: Sep. 27, 2004

(65) Prior Publication Data

US 2006/0065240 A1 Mar. 30, 2006

(51) Int. Cl.
*F02M 57/02* (2006.01)

(52) U.S. Cl. ..... 123/446; 123/467; 123/510

(58) Field of Classification Search ..... 123/446, 123/447, 467, 510
See application file for complete search history.

(56) References Cited

U.S. PATENT DOCUMENTS 4,971,016 A * 11/1990 Peters et al. ..... 123/500
6,453,872 B1 * 9/2002 Miyajima et al. ..... 123/298
6,575,139 B1 * 6/2003 Rodriguez-Amaya et al. ... 123/467
6,871,792 B1 * 3/2005 Pellizzari ..... 239/5

FOREIGN PATENT DOCUMENTS

| | | |
|---|---|---|
| DE | 2921766 | 12/1980 |
| DE | 3821020 | 12/1989 |
| DE | 10348404 | 4/2004 |
| JP | 2001241368 | 9/2001 |

* cited by examiner

*Primary Examiner*—Thomas Moulis
(74) *Attorney, Agent, or Firm*—David P. Wood

(57) ABSTRACT

A fuel injection apparatus for use in an internal combustion engine includes a fuel injector having a valve member which is operable to control injection of fuel through an injector outlet, a first supply path having a first path length for delivering fuel to an injector control chamber, a second supply path having a second path length for delivering fuel to an injector delivery chamber and a control valve for controlling fuel pressure within the injector control chamber so as to control movement of the valve member. An actuation means is arranged to vary at least one of the first and second path lengths in response to one or more injection parameters. Varying the first and/or second path length enables resonant pressure pulses within the control chamber and/or delivery chamber to be optimized so as to minimize the pressure differential across the valve needle at the instant of closure of the control valve to terminate injection, thus reducing needle closure response.

20 Claims, 2 Drawing Sheets

FUEL INJECTION APPARATUS

TECHNICAL FIELD

The invention relates to a fuel injection apparatus for use in an internal combustion engine, and in particular a compression ignition internal combustion engine. The fuel injection apparatus includes a fuel injector having a valve needle for controlling injection of fuel through an injector outlet, and a control valve for controlling movement of the valve so as to control injection.

BACKGROUND ART

Known fuel injectors for use in diesel (compression ignition) engines include a valve needle which is movable within an injector body, often referred to as the nozzle body, to control fuel delivery through a plurality of injector outlets provided in the body. Movement of the valve needle may be controlled by several means, one of which involves the use of a control valve for controlling a control chamber pressure at a back end of the needle located remote from the injector outlet. The injector includes a delivery chamber which receives fuel from a high pressure fuel source, for example a common rail. Thrust surfaces of the valve needle are exposed to fuel pressure within the delivery chamber, whereas the back end of the valve needle is exposed to fuel pressure within the control chamber.

The control chamber receives fuel via a first flow path and the delivery chamber receives fuel through a second flow path, with both flow paths receiving fuel from the common rail. Typically, the common rail supplies fuel to a plurality of other injectors of the system also in a similar manner. A closing spring is typically provided to urge the valve needle closed in circumstances in which pressure in the rail is low e.g. engine start-up.

In order to move the valve needle within the nozzle body so as to open the outlets to commence injection, it is necessary to create a pressure differential across the valve needle so that the lifting force acting on the valve needle thrust surfaces is sufficient to overcome the closing force acting on the back end of the needle. The closing force acting on the needle is a combination of the spring force and the force due to fuel pressure within the control chamber. The control chamber is provided with a control valve operable to control whether the control chamber communicates with a low pressure reservoir or fuel drain.

In order to initiate injection, the control valve is actuated to open communication between the control chamber and the low pressure drain, thus allowing fuel pressure in the control chamber to decay. A point will be reached at which the downward force acting on the valve needle is reduced sufficiently for the lifting force to cause the needle to lift to open the outlets, thereby commencing injection.

In order to terminate injection, the control valve is de-actuated to close communication between the control chamber and the fuel drain and, hence, re-establishing high fuel pressure in the control chamber. A point will be reached at which the downward closing force acting on the valve needle is sufficient to overcome the upward lifting force acting on the valve needle and, hence, the valve needle is forced to close to terminate injection.

In order to benefit engine emissions it is desirable to have accurate control over the timing of valve needle movement, particularly at the end of injection. The actual time at which the valve needle is caused to close is determined by the rate at which fuel pressure is re-established within the control chamber following closure of the control valve. In known systems, it can be a disadvantage that recovery of control chamber pressure at the end of injection is too slow, or at least cannot be controlled with sufficient accuracy.

It is an object of the present invention to provide a fuel injection apparatus which addresses this problem.

SUMMARY OF THE INVENTION

According to a first aspect of the present invention there is provided a fuel injection apparatus for use in an internal combustion engine, the fuel injection apparatus including a fuel injector having a valve member which is operable to control injection of fuel through an injector outlet, a first supply path having a first path length for delivering fuel to an injector control chamber and a second supply path having a second path length for delivering fuel to an injector delivery chamber. A control valve is arranged to control fuel pressure within the injector control chamber so as to control movement of the valve member, and an actuation means or device is provided to vary at least one of the first and the second path lengths in response to one or more injection parameters.

In one embodiment the control valve may be operable between an open position, in which the control chamber communicates with a low pressure drain, and a closed position in which communication between the control chamber and the low pressure drain is broken.

In another embodiment the control valve may be operable between an open position, in which the control chamber communicates with a low pressure drain and communication between the control chamber and the first supply path is broken, and a closed position in which the control chamber communicates with the first supply path and communication between the control chamber and the low pressure drain is broken.

In one embodiment, the actuation means is arranged to vary the length of the first path length in response to the injection parameter(s). In other words, the length of the supply path to the control chamber, between a source of fuel at high pressure and the control chamber, is varied by the actuation means.

When the control valve is open and the valve needle is lifted to allow injection, resonance pulses through the first flow path give rise to pressure fluctuations within the control chamber. By varying the path length of the first supply path it is possible to optimise the resonance frequency of the pressure pulse so that the occurrence of a peak in control chamber pressure coincides with activation of a command signal so as to close the control valve to terminate injection. This allows control chamber pressure to be recovered more quickly and also controlled with greater accuracy. As control chamber pressure can be recovered more quickly to terminate injection, valve needle closure can be achieved more rapidly. This improves exhaust emissions and also allows the minimum separation period between subsequent injection events, for example pilot/main injections and main/post injections, to be reduced giving greater scope for varying the injection profile.

The fuel injection apparatus may also a control valve actuator operable to cause the control valve to the closed position at a valve closure time, the actuation means being arranged to vary the length of the first path length so that the fuel pressure differential between the injector control chamber and the injector delivery chamber has a minimum value substantially at the valve closure time. For example, the control valve actuator may be a piezoelectric actuator, or alternatively may be an electromagnetic actuator.

The actuation means for controlling the flow path length may include an actuator in the form of an electromagnetic or piezoelectric actuator. The first supply path may be defined by a first fuel pipe arranged, at least in part, within an accumulator volume, or common rail, for storing high pressure fuel at a level suitable for injection.

The first fuel pipe preferably has an inlet located within the accumulator volume and an outlet for communication with the control chamber.

The common rail housing and the injector body maintain a fixed relationship relative to one another at all times, but by increasing and decreasing the amount by which the first fuel pipe extends into the accumulator volume, the position of the inlet, and hence the first path length, can be varied to adjust the frequency of resonance pressure pulses within the first supply path and the control chamber.

Optionally, the first fuel pipe comprises first and second telescopic pipe sections, wherein the actuation means is arranged to control movement of the second pipe section relative to the first pipe section, thereby to vary the first flow path length of the first fuel pipe.

The second supply path be defined by a second fuel pipe which communicates, at a first end thereof, with the accumulator volume and, at a second end thereof, with the injector delivery chamber.

In an alternative embodiment, the actuation means is arranged to vary the length of the second path length in response to the one or more injection parameters, thereby to minimise a fuel pressure differential between fuel within the injector control chamber and fuel within the injector delivery chamber at the time at which the injector control valve is actuated to move into the closed position.

It is also feasible for the actuation means to include first and second actuators, a first actuator for varying the length of the first path length in response to one or more injection parameters, and a second actuator for varying the length of the second path length in response to one or more injection parameters, thereby to minimise a fuel pressure differential between the control chamber and the delivery chamber.

In another embodiment of the invention, the apparatus may include an adjustable arrangement for varying the path length of the first or second supply path. For example, the adjustable arrangement may include a bellows arrangement, said bellows arrangement being actuable by said actuation means so as to vary path length. Other adjustable arrangements for varying path length are also envisaged, for example other extendible pipe configurations.

The injection apparatus may be manufactured and/or supplied to include an accumulator volume for receiving fuel at a high pressure level for injection. The accumulator volume may be a common rail for supplying fuel to a plurality of injectors of the engine, or alternatively the injection apparatus may be such that the accumulator volume is dedicated to only one injector of the engine (e.g. a unit injector apparatus).

According to a second aspect of the invention, a fuel injection apparatus for use in an internal combustion engine includes a common rail for storing fuel at high pressure, a fuel injector having a valve member which is operable to control injection of fuel through an injector outlet, a first supply path of first path length for delivering fuel from the common rail to an injector control chamber, a second supply path of second path length for delivering fuel from the common rail to an injector delivery chamber, a control valve operable between open and closed positions to control fuel pressure within the injector control chamber, and an actuation means for varying at least one of the first or second path lengths in response to one or more injection parameters, thereby to minimise a fuel pressure differential between the control chamber and the delivery chamber at a time at which the control valve is actuated to move between the open and closed positions to terminate injection.

According to a third aspect of the invention, there is provided a method of controlling injection of fuel by a fuel injection apparatus of the first or second aspect of the invention, the method including varying the first or second fuel path lengths in response to one or more injection parameters of an injection event so as to optimise a fuel pressure differential between the injector control chamber and the injector delivery chamber at the time at which the control valve is actuated to close at the end of the injection event.

Preferred and/or optional features of the first aspect of the invention are equally applicable for implementation in the apparatus of the second aspect of the invention or in the method of the third aspect of the invention.

BRIEF DESCRIPTION OF THE DRAWINGS

The invention will now be described, by way of example only, with reference to the accompanying drawings in which.

DESCRIPTION OF THE PREFERRED EMBODIMENTS

Figure 1:
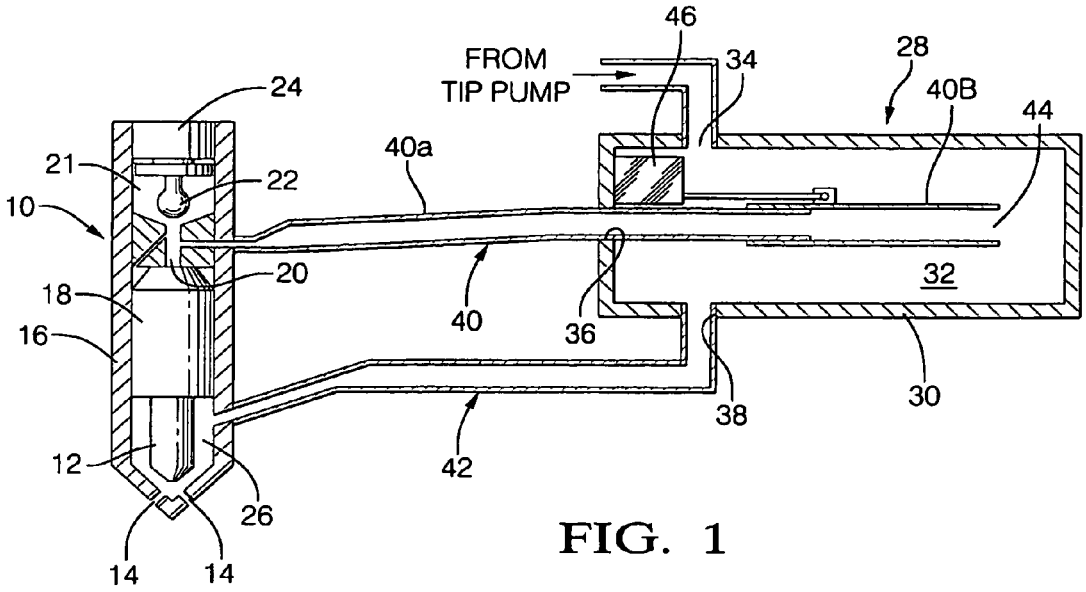
FIG. 1 is a schematic diagram of a first embodiment of the fuel injection apparatus of the present invention.
Figure 1A:
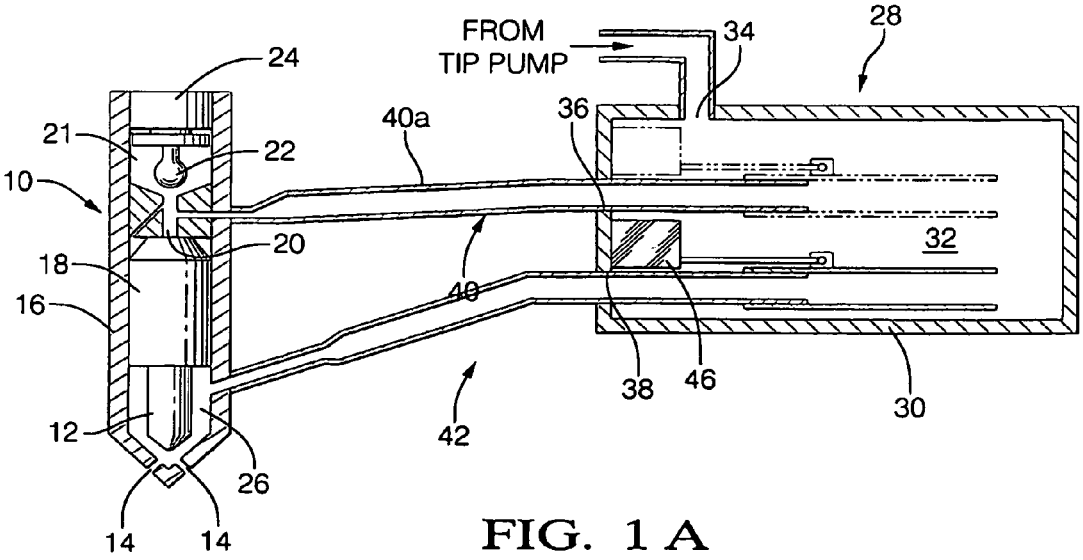

Referring to FIG. 1, a fuel injection apparatus of the present invention includes a fuel injector 10 having a valve member 12, or valve needle, which is engageable with a valve needle seating (not identified) to control fuel delivery through a plurality of injector outlets 14 provided in an injector body 16 within which the valve needle 12 moves. Two injector outlets 14 are shown in FIG. 1, although in practice any number of injector outlets may be provided.

The valve needle 12 of the injector 10 includes a seating end, which engages with the valve needle seating to control injection through the injector outlets 14, and an upper end 18 remote from the seating end. The upper end 18 of the valve needle 12 has an end surface exposed to fuel pressure within an injector control chamber 20 which is arranged to receive fuel at high pressure. An injector control valve 22 is operable between open and closed positions so as to control fuel pressure within the control chamber 20 in a manner which would be familiar to persons skilled in the field of diesel fuel injection systems. When the injector control valve 22 is open (as shown in FIG. 1), the control chamber 20 is brought into communication with a region or chamber 21 of low pressure which communicates with a low pressure drain or fuel reservoir (not shown). When the injector control valve 22 is closed, communication between the low pressure chamber 21 and the control chamber 20 is broken. The injector control valve 22 is provided with an actuation device or actuator 24 for moving the control valve 22 between its open and closed positions. For example, the actuator 24 may be an electromagnetic solenoid actuator or a piezoelectric actuator.

The injector 10 also includes a delivery chamber 26 for receiving fuel at high pressure, and from where fuel is injected through the outlets 14 into an engine combustion space when the valve needle 12 is lifted away from the valve needle seating. The valve needle 12 is provided with thrust surfaces (not indicated) having a surface area and orientation such that the pressure of fuel within the delivery chamber 26 applies an upward lifting force to the valve needle 12 to urge the valve needle 12 away from its seating. At the upper end 18 of the valve needle 12, fuel pressure within the control chamber 20 applies a downward closing force to the valve needle 12 to urge the valve needle 12 towards its seating. A closing spring (not shown) may also be arranged to act on the valve needle to urge the needle into the closed position. It is by controlling the pressure difference across the valve needle 12, therefore, that valve needle movement can be controlled to control injection through the outlets 14, as will be described in further detail below.

The injector 10 is supplied with fuel from a fuel source in the form of common rail 28 for storing high pressure fuel at a level suitable for injection. The common rail 28 includes a rail housing 30 defining an accumulator or rail volume 32, which is supplied with fuel through a rail inlet 34 from a high pressure fuel pump (not shown) in a known manner.

The rail housing 30 is provided with first and second openings, 36, 38 respectively. The first opening 36 receives a fuel pipe defining a first supply path 40 through which high pressure fuel is supplied from the rail volume 32 to the injector control chamber 20. The second opening 38 defines an inlet to a second fuel pipe defining a second supply path 42 through which high pressure fuel is supplied from the rail volume 32 to the injector delivery chamber 26.

The first supply path 40 comprises first and second pipe sections, 40*a*, 40*b* respectively, with the second pipe section 40*b* having a larger diameter than that of the first pipe section 40*a* and defining an inlet 44 to the first flow path 40. The outlet of the first supply path 40, being defined by the first pipe section 40*a*, communicates with the injector control chamber 20. The distance between the inlet and outlet ends of the first supply path 40 is herein referred to as the first path length, L1.

The first pipe section 40*a* of the first supply path 40 co-operates, in a telescopic fashion, with the second pipe section 40*b*, and an actuation means in the form of an actuator 46 is provided to control the position of the second pipe section 40*b* relative to the first pipe section 40*a* so as to permit adjustment of the first path length L1 between the inlet and outlet ends of the first supply path 40. The actuator 46 may be actuated to move the second pipe section 40*b* to the right in the illustration shown, in which case the first path length L1 is increased. Alternatively, the actuator device 46 may be actuated to move the second pipe section 40*b* to the left, in which case the first path length L1 is decreased.

In use, with the rail volume 32 charged with fuel at high pressure, and with the injector control valve 22 in a closed position, fuel pressure within control chamber 20 is high as fuel delivered through the first supply path 40 is unable to flow past the closed valve 22 to low pressure. A force due to high pressure fuel within the control chamber 20 acts on the valve needle 12, urging the needle 12 towards the valve needle seating to prevent injection through the outlets 14. In such circumstances, it will be appreciated that the upwardly directed force on the valve needle 12 (i.e. the lifting force) due to fuel pressure within the delivery chamber 26 is insufficient to overcome the force due to high pressure fuel within the control chamber 20 (acting in combination with the closing spring if provided) and, hence, the valve needle 12 remains seated. In this mode of operation, no injection takes place through the outlets 14 in such circumstances.

When it is desired to commence injection, the control valve 22 is actuated to open so that the control chamber 20 is brought into communication with the low pressure region 21. In such circumstances, the pressure of fuel within the control chamber 20 is able to flow to the low pressure drain through the open valve 22 so that pressure within the control chamber 20 is reduced. As a result of fuel pressure within the control chamber 20 being reduced, a point will be reached at which the lifting force acting on the valve needle 12 is sufficient to overcome the closing force acting on the valve needle 12, thereby causing the valve needle 12 to move away from its seating to open the injector outlets 14. As a result, injection is commenced.

After a predetermined period for injection of fuel, the actuator 24 for the control valve is de-actuated so as to close the control valve 22, thereby breaking communication between the control chamber 20 and the low pressure region 21 so that fuel pressure within the control chamber 20 starts to increase. As high pressure fuel is re-established within the control chamber 20, a point will be reached at which the downwards closing force acting on the valve needle 12 is sufficient to overcome the upwards lifting force acting on the valve needle 12 and, hence, the valve needle 12 will be caused to close to terminate injection.

The control valve actuator 24 is controlled by means of a controller forming part of the engine management system. In order to terminate injection, a control signal, or command signal, is supplied by the controller to the control valve actuator 24 to initiate movement of the control valve 22 from the open position to the closed position. A short time after the command signal is activated, the control valve 22 will start to move. A short time after the control valve 22 starts to move, the valve needle 12 starts to close as pressure in the control chamber 20 starts to increase.

Figure 2:
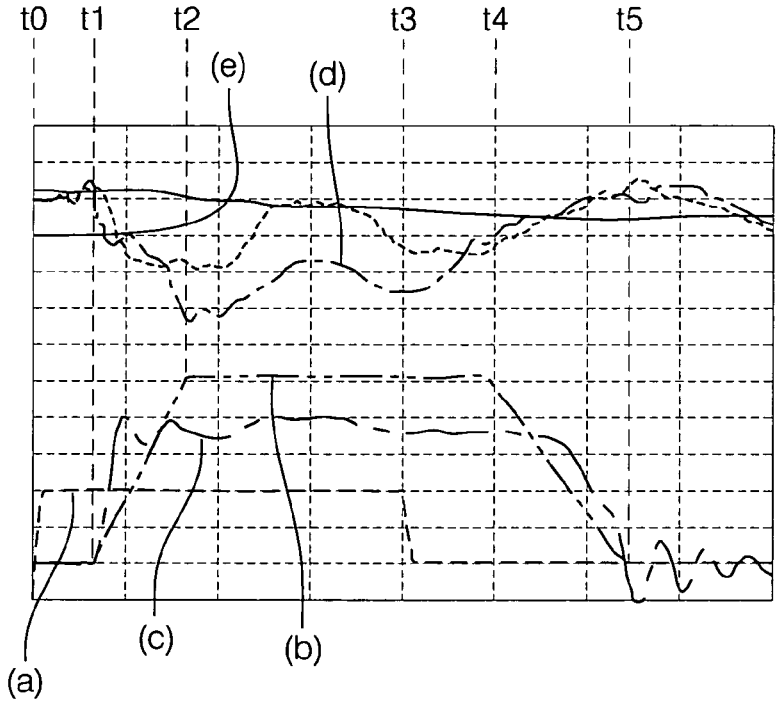
FIG. 2 is a graphical illustration of (a) control valve command signal, (b) injector valve needle lift, (c) injection rate, (d) injector control chamber pressure, and (e) injector delivery chamber pressure, for a known fuel injection apparatus having fixed supply path lengths to the control chamber and the delivery chamber.

In order to highlight the distinguishing feature of the present invention, FIG. 2 illustrates, graphically, several characteristics of an injection event for a known fuel injection apparatus which is controlled in the aforementioned manner. In the known fuel injection apparatus the first supply path (represented by 40 in FIG. 1) into the injector control chamber is of fixed length. In FIG. 2, trace (a) represents the command signal which is supplied to the actuator 24 for the control valve 22 and trace (b) represents valve needle lift, that is the extent to which the valve needle 12 is lifted away from the valve needle seating. It can be seen that there is a short time delay between the command signal being initiated (command signal on), at time t0, to open the control valve 22 and the valve needle 12 starting to move at time t1. The valve needle 12 reaches full lift at time t2.

At time t3 the command signal (b) is turned off so as to initiate closure of the control valve 22. A short time after the command signal is turned off, pressure in the control chamber 20 has increased sufficiently to cause the valve needle 12 to start to move towards its seating at time t4. Thus, for the period between times t2 and t4 the valve needle 12 is at full lift. At time t5 the valve needle 12 has moved through its full range of travel to seat against the valve needle seating, thereby terminating injection. Trace (c) represents the injection rate during the course of the injection event, between times t1 and t5.

Trace (d) and trace (e) represent fuel pressure within the injector control chamber 20 and the injector delivery chamber 26, respectively. It can be seen from trace (d) that pressure within the control chamber 20 fluctuates during the injection event due to resonance pressure pulses within the first supply path 40 and the control chamber 20. It can be seen from trace (e) that pressure in the delivery chamber 26 also fluctuates during an injection event due to such resonance pressure pulses. It will be appreciated that the apparatus is configured to ensure that, despite cyclic pressure fluctuations within the control and delivery chambers 20, 26 during an injection event caused by resonance pressure pulses, at all times the pressure differential across the valve needle 12 remains sufficient to maintain the needle in its fully lifted position.

It is a notable feature of the characteristics shown in FIG. 2, that at the instant the command signal is turn off to close the control valve (i.e. time t3), the difference in pressure, ΔP, between fuel in the control chamber 20 and fuel in the delivery chamber 26 is relatively large. The control chamber pressure recovery rate, that is the rate at which fuel pressure within the control chamber 20 starts to build up to the level required to cause the valve needle 12 to start to close, is therefore relatively slow. As a result, valve needle closure is relatively slow.

Figure 3:
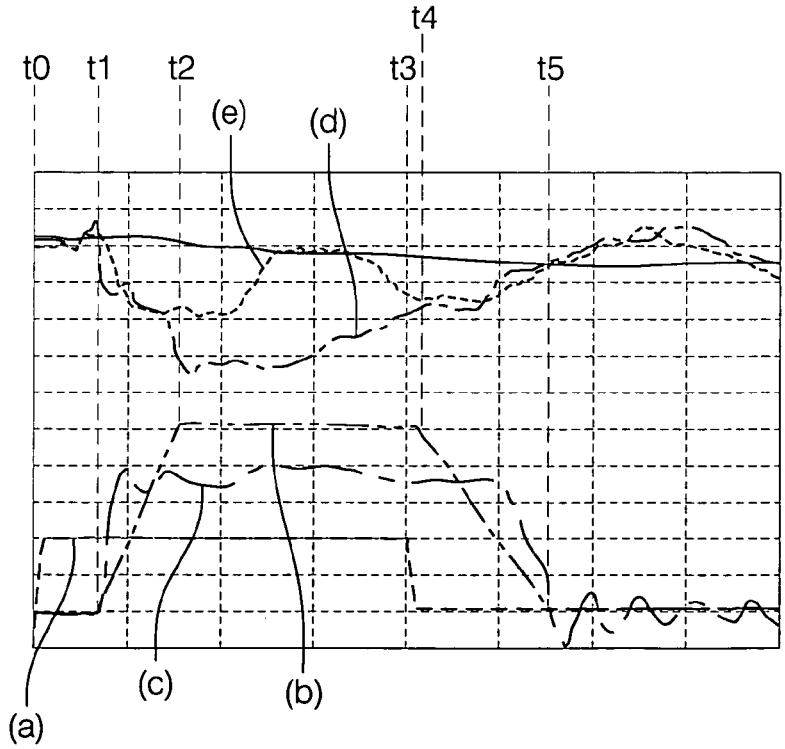
FIG. 3 is a graphical illustration of (a) control valve command signal, (b) injector valve needle lift, (c) injection rate, (d) injector control chamber pressure, and (e) injector delivery chamber pressure, for a fuel injection apparatus as shown in FIG. 1 in which one or more of the supply path lengths to the control chamber and the delivery chamber is variable.

The present invention recognises that by selecting the first path length L1 of the first supply path 40 so that the resonant pressure pulsation has a cyclic frequency giving rise to a peak in control chamber pressure at the same instant, or at substantially the same instant, as the command signal is turned off to close the control valve, the recovery of fuel pressure within the control chamber 20 to terminate injection can be achieved more rapidly. FIG. 3 illustrates, graphically, the characteristics (a) to (e) for a fuel injection apparatus such as that shown in FIG. 1, in which the flow path length L1 of the first supply path 40 has been optimised to provide this beneficial characteristic. It can be seen from trace (d) that the peak in pressure within the control chamber 20, as a result of the resonance pressure fluctuation, occurs at about the same time, t3, as the control valve command signal (b) is turned off to close the control valve 22. The fuel pressure difference, ΔP, between the control chamber 20 and the delivery chamber 26 is thus reduced (in comparison with FIG. 2), and preferably minimised, so that high fuel pressure within the control chamber 20 may be established rapidly to expedite the timing of valve needle closure.

Reference to the fuel pressure differential, ΔP, being substantially minimised shall be taken to mean that the pressure differential between fuel within the control chamber 20 and fuel within the delivery chamber 26 has a minimum value at that time during the period of the injection event for which the valve needle is at full lift when the control valve 20 is actuated/de-actuated to close to terminate injection. It is the fuel pressure differential, ΔP, that influences how quickly a suitably high pressure can be re-established within the control chamber 20 to overcome the hydraulic lifting force acting on the valve needle 12.

Referring again to FIG. 1, the length L1 of the first supply path 40 is optimised by varying the position of the second pipe section 40*b* relative to the first pipe section 40*a* under the control of the actuator 46. In practice, the actuator device 46 will be controlled in response to one or more parameters of an injection event, for example fuel pressure within the rail volume 32 or the duration of the injection event which is calculated in the controller in response to an engine demand signal. The engine controller may be programmed with pre-calibrated data relating optimum flow path length L1 to injection pressure and/or injection duration, or alternatively a calculation of the optimum path length L1 may be carried out in software in real-time for each injection event, or as necessary. Other parameters of the injection event may be used to fine-tune the optimum path length L1, if necessary, in a similar manner.

It is one advantage of providing more rapid valve needle closure that emission levels are improved. Additionally, the minimum separation time between the end of one injection of fuel and the start of a subsequent injection of fuel is reduced, allowing closer coupled injections of fuel, such as pilot/main or main/post injections of fuel.

In an alternative embodiment of the invention to that shown, the second supply path 42 may be provided with an actuator, such as actuator 46, for varying the second path length L2. The second supply path 42 may, therefore, be of telescopic construction, having first and second pipe sections such as those shown in FIG. 1 for the first supply path 40. The second path length L2 may be optimised so that the fuel differential pressure, ΔP, across that valve needle 12, between the control chamber 20 and the injector delivery chamber 26 is minimised at the instant the control valve command signal causes the control valve 22 to close to re-seat the valve needle 12.

In a further alternative embodiment, both the first path length L1 and the second path length L2 may be varied in response to one or more injection parameters to optimise the fuel pressure differential across the valve needle as the control valve is caused to close. In this embodiment two actuators are provided, one for varying the length of the first supply path 40 and one for varying the length of the second supply path 42. This embodiment has an increased part count and, thus, may be less desirable to use in practice.

In another embodiment of the invention, alternative means may be provided for adjusting the length of the first and/or second paths lengths, instead of a telescopic arrangement of pipes. For example, a bellows arrangement may be used to adjust the first and/or second path length. In this case the actuation means may include a pneumatic or hydraulic device for actuating the bellows. Other extendible pipe configurations are also envisaged.

In the foregoing description, operation of the control valve 22 has been described in terms of actuation of the actuator 24 to open the control valve 22 and de-actuation of the actuator 24 to close the control valve 22. However, it will be appreciated that the 'polarity' of the actuation for valve opening and closing may be either way around, depending on the type of actuator for example, so that the actuator 24 may be positively actuated to close the control valve 22, rather than open it.

The control valve 22 for the control chamber 20 is described as being a two-way valve, which functions between open and closed positions to either open or close communication between the control chamber 20 and the low pressure region 21, whilst at all times allowing the first supply path 40 to communicate with the control chamber 20. A possible disadvantage of this arrangement is that, when the control valve 22 is opened to commence injection, there is a continuous flow of fuel between the first supply path 40 and low pressure, via the open control valve 22. For this reason it may be preferable to provide the injection apparatus with a three-way control valve, whereby the control valve 22 is movable between an open position, in which the control chamber 20 communicates with the low pressure region 21 and communication between the control chamber 20 and the first supply path 40 is broken, and a closed position in which the control chamber 20 communicates with the first supply path 40 and communication between the control chamber 20 and the low pressure region 21 is broken.

The fuel injection apparatus of the present invention may be manufactured to include the common rail 28, or this component may be supplied separately. The injection system of the present invention is particularly applicable to common rail type systems, in which a common source (the rail 28) of high pressure fuel supplies fuel to a plurality of injectors 10 of the system. However, the invention is equally applicable to fuel injections systems in which each injector has a dedicated fuel source, such as in a unit injector, with the fuel source supplying fuel to the control and delivery chambers of only one associated injector. The invention is also applicable to hybrid common-rail/unit injector systems which combine functional aspects of both common rail and unit injection systems.

It will be understood by those who practice the invention and those skilled in the art, that various modifications and improvements may be made to the invention without departing from the spirit of the disclosed concept. The scope of protection afforded is to be determined by the claims and by the breadth of interpretation allowed by law.

What is claimed is:

1. A fuel injection apparatus for use in an internal combustion engine, the fuel injection apparatus including:

a fuel injector having a valve member which is operable to control injection of fuel through an injector outlet, a first supply path, having a first path length, for delivering fuel to an injector control chamber, a second supply path, having a second path length, for delivering fuel to an injector delivery chamber, a control valve for controlling fuel pressure within the injector control chamber so as to control movement of the valve member, and actuation means for varying at least one of the first or second path lengths in response to one or more injection parameters.

2. The fuel injection apparatus as claimed in claim 1, wherein the actuation means includes a first actuator arranged to vary the first path length of the first supply path in response to one or more injection parameters.

3. The fuel injection apparatus as claimed in claim 2, further comprising a control valve actuator for the control valve, the control valve actuator being operable to move the control valve to the closed position at a valve closure time, the first actuator being arranged to vary the first path length of the first supply path so that the pressure difference between fuel within the injector control chamber and fuel within the injector delivery chamber is minimised at the valve closure time.

4. The fuel injection apparatus as claimed in claim 3, wherein the control valve actuator is an electromagnetic actuator.

5. The fuel injection apparatus as claimed in claim 1, wherein the actuation means includes a second actuator arranged to vary the second path length of the second supply path in response to the one or more injection parameters, thereby to minimise a fuel pressure differential between the injector control chamber and the injector delivery chamber at the time when the control valve is actuated to move into the closed position.

6. The fuel injection apparatus as claimed in claim 2, wherein the actuation means further includes a second actuator for varying the second path length of the second supply path in response to one or more injection parameters, thereby to minimise a fuel pressure differential between the injector control chamber and the injector delivery chamber at the time when the control valve is actuated to move into the closed position.

7. The fuel injection apparatus as claimed in claim 1, wherein the actuation means includes an electromagnetic actuator.

8. The fuel injection apparatus as claimed in claim 1, wherein the actuation means includes a piezoelectric actuator.

9. The fuel injection apparatus as claimed in claim 1, wherein the control valve is operable between an open position, in which the injector control chamber communicates with a low pressure fuel drain, and a closed position in which communication between the injector control chamber and the low pressure fuel drain is broken.

10. The fuel injection apparatus as claimed in claim 1, wherein the control valve is operable between an open position, in which the injector control chamber communicates with a low pressure fuel drain and communication between the injector control chamber and the first supply path is broken, and a closed position in which the injector control chamber communicates with the first supply path and communication between the injector control chamber and the low pressure fuel drain is broken.

11. The fuel injection apparatus as claimed in claim 1, wherein the first supply path is defined by a first fuel pipe arranged, at least in part, within an accumulator volume for storing high pressure fuel for injection.

12. The fuel injection apparatus as claimed in claim 11, wherein the first fuel pipe has an inlet within the accumulator volume and an outlet for communication with the injector control chamber.

13. The fuel injection apparatus as claimed in claim 12, wherein the first fuel pipe comprises first and second telescopic pipe sections, wherein the actuation means is arranged to control movement of the second pipe section relative to the first pipe section, thereby to vary the first path length of the first fuel pipe.

14. The fuel injection apparatus as claimed in claim 1, wherein the second supply path is defined by a second fuel pipe which communicates, at a first end thereof, with the accumulator volume and, at a second end thereof, with the injector delivery chamber.

15. The fuel injection apparatus as claimed in claim 14, wherein the second fuel pipe comprises first and second telescopic pipe sections, wherein the actuation means is arranged to control movement of the second pipe section relative to the first pipe section, thereby to vary the second path length of the second fuel pipe.

16. The fuel injection apparatus as claimed in claim 1, wherein at least one of the first or second supply paths is provided with a bellows arrangement, said bellows being actuable by said actuation means so as to vary path length.

17. The fuel injection apparatus as claimed in claim 1, including an accumulator volume for receiving fuel at a high pressure level.

18. The fuel injection apparatus as claimed in claim 17, wherein the accumulator volume is a common rail for supplying fuel to a plurality of injectors of the engine.

19. A fuel injection apparatus for use in an internal combustion engine, the fuel injection apparatus including:

a common rail for receiving fuel at a high pressure level, a fuel injector having a valve member which is operable to control injection of fuel through an injector outlet, a first supply path of first path length for delivering fuel from the common rail to an injector control chamber, a second supply path of second path length for delivering fuel from the common rail to an injector delivery chamber, a control valve operable between open and closed positions to control fuel pressure within the injector control chamber, and an actuation means for varying at least one of the first and second path lengths in response to one or more injection parameters, thereby to minimise a pressure differential between fuel within the injector control chamber and fuel within the injector delivery chamber at a time at which the control valve is actuated to move between the open and closed positions.

20. A method of controlling injection of fuel by a fuel injection apparatus as claimed in claim 1, the method comprising varying at least one of the first and second fuel path lengths in response to one or more injection parameters of an injection event so as to optimise a fuel pressure differential between the injector control chamber and the injector delivery chamber at the time at which the control valve is actuated to close at the end of the injection event.

* * * * *